US005970959A

United States Patent [19]

Stroud

[11] Patent Number: 5,970,959

[45] **Date of Patent: *Oct. 26, 1999**

[54] SUPERCHARGER CONTAINMENT DEVICE

[76] Inventor: Robert W. Stroud, 9000 E. Memorial, Jones, Okla. 73049

[ * ] Notice: This patent issued on a continued prosecution application filed under 37 CFR 1.53(d), and is subject to the twenty year patent term provisions of 35 U.S.C. 154(a)(2).

[21] Appl. No.: 08/735,494

[22] Filed: Oct. 23, 1996

Related U.S. Application Data

[63] Continuation of application No. 08/420,368, Apr. 11, 1995, abandoned.

[51] Int. Cl.[6] ..... F02B 39/16

[52] U.S. Cl. ..... 123/559.1

[58] Field of Search ..... 123/559.1; 24/163 K, 24/198, 200; 2/421

[56] References Cited

U.S. PATENT DOCUMENTS

| | | | |
|---|---|---|---|
| 758,146 | 4/1904 | Peterson | 24/198 |
| 4,452,563 | 6/1984 | Belanger et al. | 415/9 |
| 4,595,349 | 6/1986 | Preston et al. | 418/206.1 |
| 5,272,773 | 12/1993 | Kamata | 2/421 |
| 5,431,318 | 7/1995 | Garcia | 224/192 |
| 5,456,215 | 10/1995 | Deutscher et al. | 119/850 |

OTHER PUBLICATIONS

SFI Foundation, Inc., Specification 14.2, Fuel Supercharger Restraint Devices, Jan. 29, 1992.

SFI Foundation, Inc., Specification 14.21, Screw–Type Supercharger Restraint Devices, Jun. 18, 1991.

SFI Foundation, Inc., Specification 14.3, Nitro–Methane Fuel Supercharger Restraint Devices, Oct. 30, 1995.

Drag Racing Magazine, Apr. 1990.

Drag Racing, "Pretty Quick", Dec. 1988, pp. 18–21.

Drag Racing, May 1989.

Drag Racing, Apr. 1990, p. 51.

Hot Rod, Jan. 1993.

Super Stock and Drag Illustrated, Jun. 1991, pp. 34 and 35.

National Dragster, "TAK's 'Boom Bag' restraint passes ballistics tests", Aug. 22, 1986.

National Dragster, "Staging Light", Mar. 21, 1986.

National Dragster, "New supercharger restraint blanket designed to confine bits of casing", Mar. 21, 1986.

*Primary Examiner*—Michael Koczo

[57] ABSTRACT

A front containment device for a supercharger attached to an internal combustion engine of a racing vehicle, such as a car. The preferred device includes a cover to sufficiently contain a front end of the supercharger, wherein the cover controls and stops parts that are projected through the front end of the supercharger during an engine explosion. The cover is received around an external drive mechanism and generally overlays the front end of the supercharger. The cover is coupled with the supercharger using a pair of side straps and a connecting buckle. A rear strap is used for attaching the device to the engine or other suitable mount. The cover includes a plurality of holes, wherein bolts are received through the holes and connected to the supercharger for positioning the cover thereon. Additionally, the cover has a plurality of specially designed apertures for accommodating a portable starter, wherein the starter is used to start the engine associated with the supercharger.

9 Claims, 2 Drawing Sheets

SUPERCHARGER CONTAINMENT DEVICE

This application is a continuation of application Ser. No. 08/420,368 filed on Mar. 11, 1995, abandoned.

BACKGROUND

The present invention relates generally to a containment device for a supercharger attached to an internal combustion engine of a racing vehicle or the like, and more particularly, to a cover that controls and stops parts projected through a front end of the supercharger during an engine explosion.

Superchargers are commonly used on internal combustion racing vehicles to force air into the engine; thus, significantly increasing the engine's power output. A conventional supercharger has a plurality of rotors disposed in a housing assembly, wherein the rotors are externally driven to force the air into the engine. Moreover, when there is an engine explosion, the rotors and other parts are frequently projected from the front end of the supercharger; wherefore, the vehicle's driver and nearby spectators are in danger of being injured by the projected objects.

For the foregoing reasons there is a need for a simple, economical and effective containment device for a supercharger; however, until now, no such device has been developed.

SUMMARY

The preferred embodiment of the invention is directed to a front containment device for a supercharger attached to an internal combustion engine of a racing vehicle, such as a car. The device includes a cover to sufficiently contain a front end of the supercharger, wherein the cover controls and stops parts that are projected through the front end during an engine explosion. The cover is received around an external drive mechanism and generally overlays the front end of the supercharger. Preferably, the cover is coupled with the supercharger using a pair of side straps and a connecting buckle. A rear strap is used for attaching the device to the engine or other suitable mount.

The cover includes a plurality of holes, wherein bolts are received through the holes and connected to the supercharger as a means for positioning the cover thereon. Additionally, the cover has a plurality of specially designed apertures for accommodating a portable starter, wherein the starter is used to start the engine associated with the supercharger.

As such, it is a first object of the present invention to provide an efficient, economical, and simple device which generally covers a front end of a supercharger.

It is a further object of the present invention to provide a device which has means for receiving an external drive mechanism of a supercharger.

It is a further object of the present invention to provide a device which contains objects projected through a front end of a supercharger.

It is a further object of the present invention to provide a device which accommodates a portable starter for starting an engine associated with a supercharger.

It is a further object of the present invention to provide a device which includes a cover made of metal, ballistic material, or other suitable material.

It is a further object of the present invention to provide a device which couples with a supercharger.

It is a final object of the present invention to provide a device which couples with a suitable mounting point, wherein supercharger parts are inhibited from exiting a front end of a supercharger.

BRIEF DESCRIPTION OF THE DRAWINGS

These and other features, aspects, and advantages of the present invention will become better understood with regard to the following description, appended claims, and accompanying drawings where:

DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications, and equivalents, which may be included within the spirit and scope of the invention as defined by the appended claims.

Figure 1:
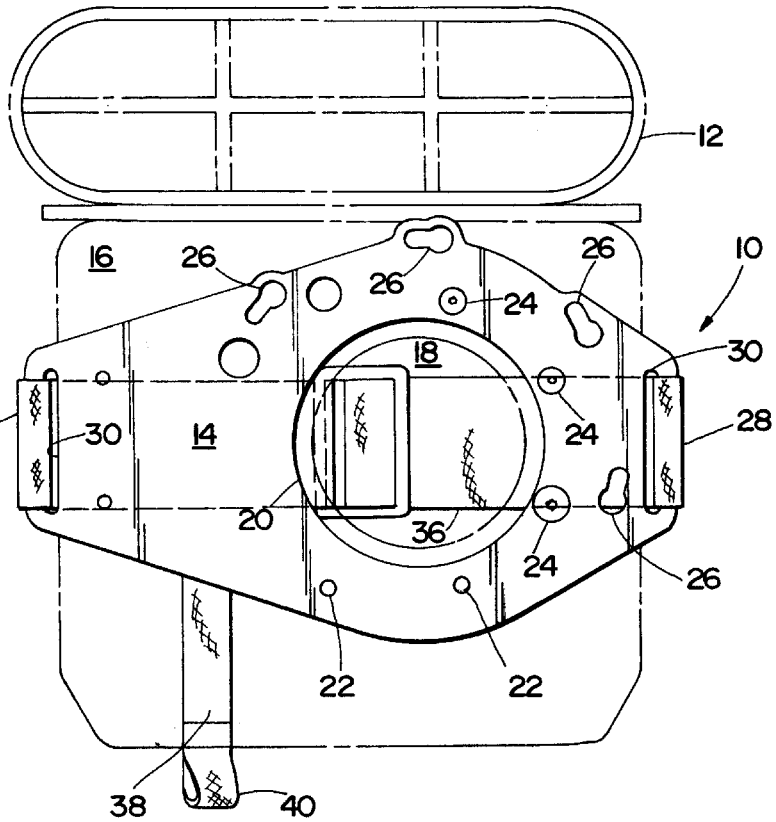
FIG. 1 is a front elevation view of a front containment device for a supercharger, wherein the device is constructed in accordance with the present embodiment of the invention and the broken line is illustrative of the supercharger.
Figure 2:
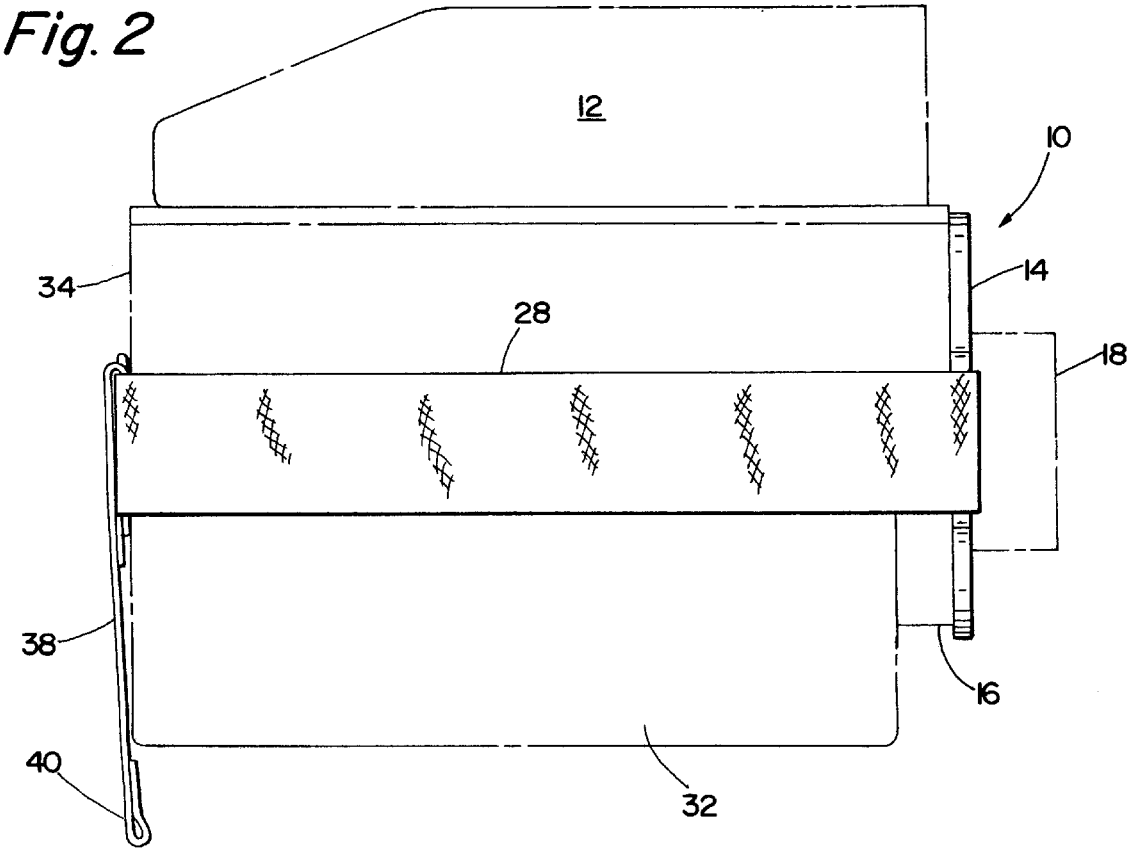
FIG. 2 is a left side elevation view of FIG. 1.

As best illustrated in FIGS. 1 and 2, the preferred version of a front containment device 10 for a supercharger 12 includes a cover 14 which fits adjacent to a front end 16 section of a supercharger housing assembly. Adjacent placement of the cover 14 includes the cover 14 being held either flush against the front end 16 or a distance therefrom, wherein parts exiting the front end 16 are inhibited by the cover 14.

The supercharger 12 is preferably attached to an internal combustion engine (not shown) of a racing vehicle, such as a car. The supercharger 12, such as a Roots-type or a screw type, is commonly known and used in the art to force air into the engine, thereby increasing the engine's power output.

The front end 16 of the supercharger 12 is defined as the supercharger housing assembly end section having an external drive mechanism 18 extending therefrom. In the art, the external drive mechanism 18 is often referred to as a snout. The external drive mechanism 18 is typically driven by the engine via a belt (not shown), wherein the mechanism 18 moves rotors inside the supercharger 12 to force the air into the engine. Furthermore, the cover 14 has an opening 20 which provides a means for receiving the external drive mechanism 18 therethrough; thus, the cover 14 is received around the mechanism 18 and positioned adjacent to the front end 16.

The cover 14 may comprise any suitable means for receiving the extended drive mechanism 18. Furthermore, the cover 14 may constitute any design which sufficiently contains the front end 16 to control and stop parts projected therefrom during an engine explosion.

As shown in FIG. 1, the cover 14 generally overlays and contains a substantial portion of the front end 16 of the supercharger 12. The cover 14 is made of metal, ballistic material or other suitable material, wherein preferred materials include steel, aluminum, magnesium or KEVLAR. Preferably, as illustrated in FIGS. 1–3, the cover 14 is constructed as a flat piece of metal although numerous configurations and materials may be utilized to prevent parts from exiting the front end 16 of the supercharger 12 upon explosion of the associated engine.

The cover 14 includes a plurality of holes 22, wherein bolts 24 or similar fastening means are received through the holes 22 and connected to the supercharger 12 to provide a means for positioning the cover 14 thereon. In addition, the cover 14 has a plurality of specially designed apertures 26 for holding a portable starter (not shown) known in the art; thus, the cover 14 and apertures 26 accommodate the starter while it is used for starting the engine associated with the supercharger 12. The bolts 24 are primarily used to prevent movement of the cover 14 during operation of the portable starter.

Figure 3:
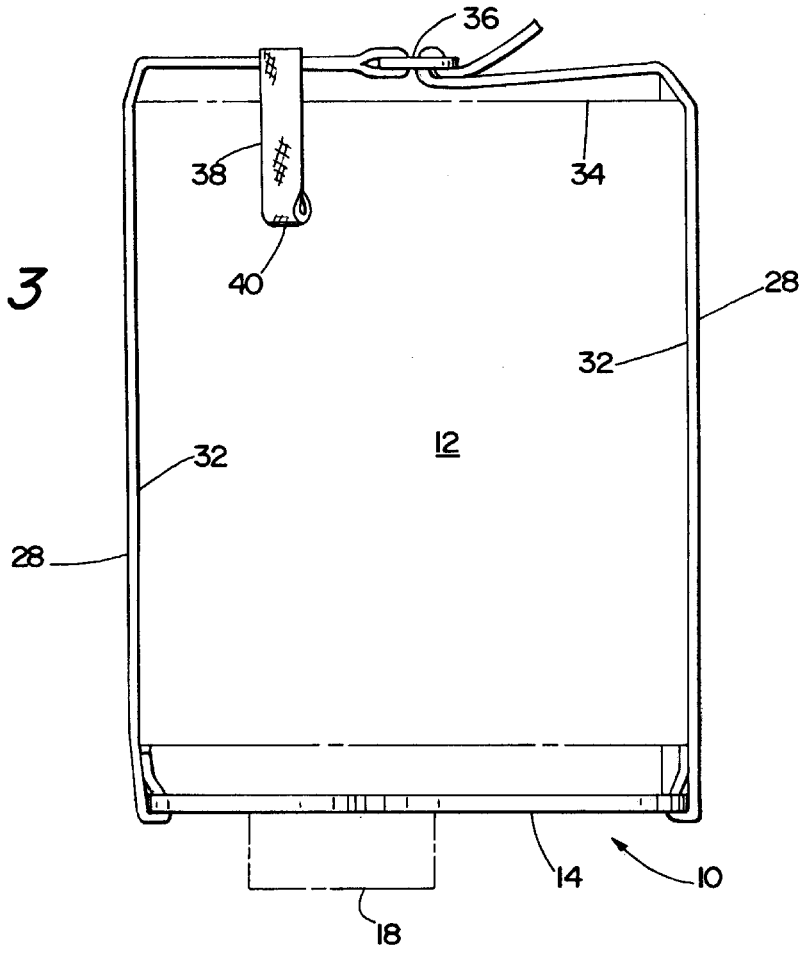
FIG. 3 is a top plan view of FIG. 1.
Figure 4:
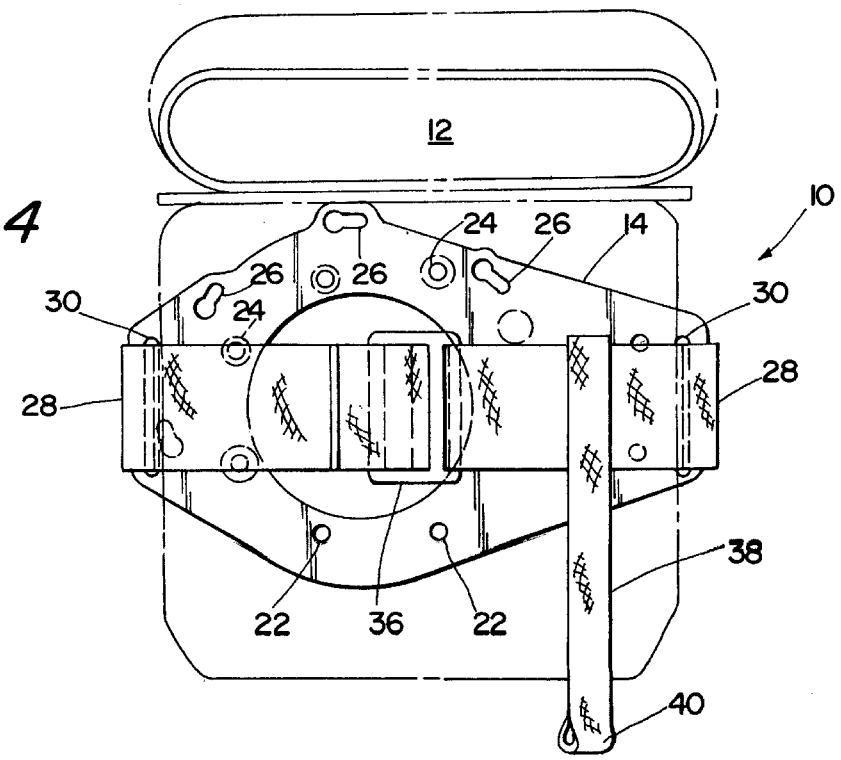
FIG. 4 is a rear elevation view of FIG. 1.

As shown in FIGS. 2–4, the cover 14 is securely coupled with the supercharger 12 using a pair of side straps 28 or other suitable coupling means. Each side strap 28 is received through a separate passage 30 on the cover 14, wherein the passages 30 are generally positioned on opposite ends of the cover 14, see FIG. 1. Preferably, each strap 28 is folded back and stitched as a means for coupling the strap 28 with the cover 14.

Referring again to FIGS. 2–4, the side straps 28 generally extend around sides 32 and a back end 34 section of the supercharger housing assembly. A buckle 36 known in the art is used for connecting the side straps 28. The buckle 36 is a single mechanism attached to one side strap 28, wherein the second side strap 28 is adjustably received through the buckle 36. Hence, the side straps 28 and buckle 36 securely couple the cover 14 with the supercharger 12.

As shown in FIGS. 2 and 4, a rear strap 38 is connected to one of the side straps 28. Preferably, the rear strap 38 is folded and stitched as a means for connecting the rear strap 38 with the side strap 28.

The rear strap 38 has a movable loop 40 or known restraint combined therewith, whereby the loop 40 secures the rear strap 38 to a mount (not shown). The mount is preferably affixed to the engine for receiving the loop 40, wherein the engine mount is known in the art and is commonly used when joining known restraint devices with a motor. Therefore, the rear strap 38 extends between the device 10 and the engine or other suitable mounting point.

The side straps 28 and rear strap 38 are preferably constructed using nylon or KEVLAR webbing. Nevertheless, any suitable materials known in the art may be used for producing the side and rear straps 28, 38.

Alternatively, the cover 14 may be attached to any suitable mounting point, such as a cage or chassis associated with the vehicle, wherein the cover 14 is located to inhibit supercharger parts from exiting the front end 16. Any suitable attaching means, such as welding, bolting or the like, may be used for attaching the cover 14 with the mounting point. Therefore, a preferred means for holding the cover 14 adjacent the front end 16 includes using the side and rear straps 28, 38; however, the cover 14 may be attached to any suitable mounting point, such as the cage or chassis, which holds the cover 14 to inhibit parts from exiting the front end 16.

In operation, the cover 14 is positioned to contain the front end 16 of the supercharger 12, wherein the external drive mechanism 18 extends through the opening 20. The bolts 24 are received through the holes 22 and attached to the supercharger 12 for positioning the cover 14 thereon. The side straps 28 are generally extended around the sides 32 and back end 34 of the supercharger 12, wherein the side straps 28 are securely and adjustably connected by the buckle 36. The loop 40 on the rear strap 38 is joined with the engine mount, thereby attaching the device 10 to the engine or other suitable mounting point. Hence, the cover 14 is securely coupled with the supercharger 12 and sufficiently overlays the front end 16 to inhibit the projection of supercharger parts therefrom during an explosion of the associated engine.

The previously described version of the invention has many advantages, including a simple, economic and safe way to construct the supercharger containment device 10. Another advantage of the present invention is that the device 10 sufficiently covers the front end 16 to effectively inhibit parts which are projected therefrom.

The foregoing descriptions of specific embodiments of the present invention have been presented for purposes of illustration and description. They are not intended to be exhaustive or to limit the invention to the precise forms disclosed and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A supercharger containment device comprising:

a Roots-type supercharger having a housing assembly with a front end, said front end having a drive mechanism extending therefrom;

a rigid cover positioned adjacent to the front end of the housing assembly, said cover having an opening with the drive mechanism extended therethrough; and strap means for coupling said cover with said supercharger.

2. The device of claim 1 wherein said cover is made of metal.

3. The device of claim 1 wherein said cover is made of ballistic material.

4. The device of claim 1 wherein said cover includes mounting means for mounting a portable starter used for starting the engine associated with the supercharger.

5. A Roots-type supercharger front end housing assembly containment device comprising:

a Roots-type supercharger having a housing assembly with a front end, said front end having a drive mechanism extending therefrom;

a rigid cover, said rigid cover being positioned generally adjacent the front end of the housing assembly and having an opening with the drive mechanism received therethrough; and a first strap coupled with said cover for securing said cover to the supercharger.

6. A Root-type supercharger front end housing assembly containment device, comprising:

a Roots-type supercharger having a housing assembly with a front end, said front end having a drive mechanism extending therefrom;

a cover having an opening which is sufficiently sized to receive a supercharger drive mechanism therethrough;

a first strap coupled with said cover for securing said cover to the supercharger; and wherein said drive mechanism is received through the opening in said cover.

7. The device of claim 6, wherein said cover is rigid.

8. A supercharger containment device comprising:

a Roots-type supercharger having a housing assembly with a front end, said front end having a drive mechanism extending therefrom;

a rigid cover positioned adjacent to the front end of the housing assembly, said cover having an opening with the drive mechanism extended therethrough; and first and second straps, each of said straps being received through a separate passage in said cover, for coupling said cover with said supercharger.

9. The device of claim 8 further comprising:

a buckle for coupling said first and second straps; and a third strap attached to one of said first and second straps.

* * * * *